United States Patent [19]

Snyder et al.

[11] Patent Number: 4,738,614

[45] Date of Patent: Apr. 19, 1988

[54] ATOMIZER FOR POST-MIXED BURNER

[75] Inventors: William J. Snyder, White Plains; Paul J. Liszewski, Yonkers, both of N.Y.

[73] Assignee: Union Carbide Corporation, Danbury, Conn.

[21] Appl. No.: 889,199

[22] Filed: Jul. 25, 1986

[51] Int. Cl.[4] ..... F23D 14/62

[52] U.S. Cl. ..... 431/8; 431/354; 239/433

[58] Field of Search ..... 431/8, 158, 354; 239/429, 433, 428.5, 310; 60/39.06, 39.05, 39.12, 39.464, 737

[56] References Cited

U.S. PATENT DOCUMENTS

| | | | |
|---|---|---|---|
| 589,342 | 8/1897 | Dolan | 431/8 |
| 794,545 | 7/1905 | Phillips, Jr. | 431/354 |
| 971,430 | 9/1910 | Drager | 431/354 |
| 2,946,185 | 7/1960 | Bayer | 239/433 X |
| 3,168,131 | 2/1965 | Gross | 431/354 |
| 3,923,448 | 12/1975 | Guth | 431/354 |
| 4,378,205 | 3/1983 | Anderson | 431/5 |
| 4,383,646 | 5/1983 | Smith | 239/433 X |
| 4,408,982 | 10/1983 | Kobayashi et al. | 431/10 |
| 4,416,610 | 11/1983 | Gallagher, Jr. | 431/354 X |
| 4,431,400 | 2/1984 | Kobayashi et al. | 431/6 |
| 4,488,682 | 12/1984 | Kobayashi et al. | 239/132.3 |
| 4,525,138 | 6/1985 | Snyder et al. | 431/187 |
| 4,541,796 | 9/1985 | Anderson | 431/187 |
| 4,541,798 | 9/1985 | Miller et al. | 431/266 |
| 4,562,966 | 1/1986 | Smith et al. | 239/433 |

FOREIGN PATENT DOCUMENTS

| | | | |
|---|---|---|---|
| 17993 | 12/1915 | United Kingdom | 431/8 |
| 2140910 | 12/1984 | United Kingdom . | |

*Primary Examiner*—Randall L. Green
*Attorney, Agent, or Firm*—Stanley Ktorides

[57] ABSTRACT

An atomizer and atomizing process of a post-mixed liquid fuel fired burner comprising angular direction of atomizing fluid into liquid fuel as it passes along a fuel passage length of increasing surface area causing the formation of a fuel film on the fuel passage surface area with the increasing thinning of the fuel film as it passes across the increasing surface area, resulting in a shearing action at the fuel passage end and the formation of an atomized spray.

17 Claims, 1 Drawing Sheet

FIG. 1
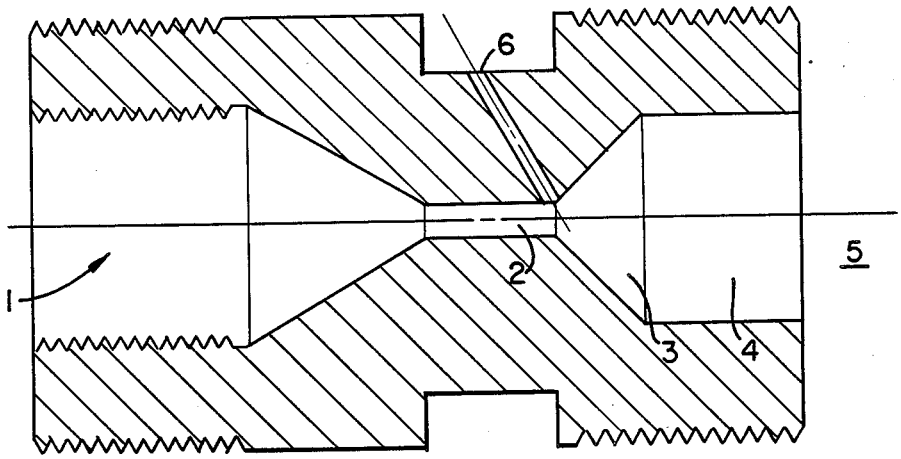
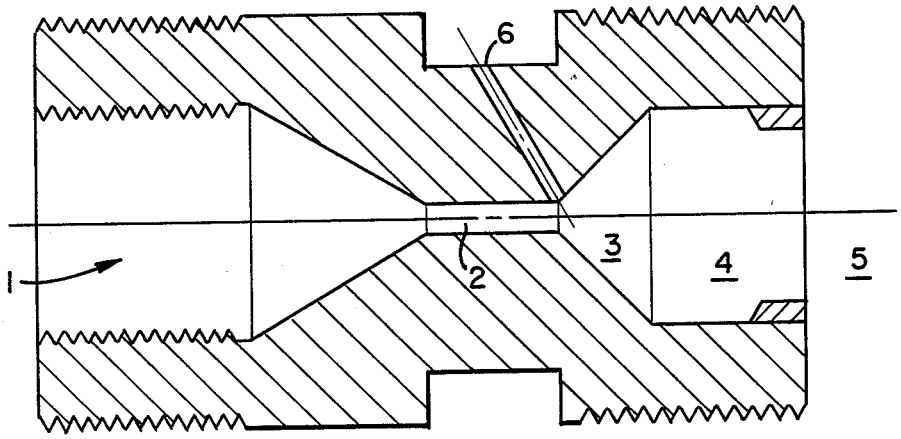
FIG. 2

ATOMIZER FOR POST-MIXED BURNER

TECHNICAL FIELD

This invention relates generally to post-mixed liquid fuel fired burners and more particularly to atomizers for post-mixed liquid fuel fired burners.

A post-mixed burner is a burner wherein fuel and oxidant are delivered in separate passages to a point outside the burner, such as a furnace, where the fuel and oxidant mix and combust. A recent significant advancement in the field of post-mixed burners is the burner described and claimed in U.S. Pat. No. 4,541,796 to Anderson which enables the attainment of a marked improvement in burner efficiency with the use of oxygen or oxygen-enriched air as the oxidant. When a post-mixed burner, such as the aforesaid Anderson burner, is employed with a liquid fuel, the liquid fuel must first be atomized before it mixes and combusts with the main oxidant in the combustion zone.

Liquid fuel atomizers are known but generally are subject to operational drawbacks. For example, pressure atomizers which require forcing liquid fuel through very small passages at high velocity are complicated to operate because of the requisite high pressure and are subject to blockage due to the very small orifices which must be employed. Mechanical atomizers, which employ a spinning member or ultrasonic vibration to disperse liquid fuel into small droplets, are limited in their applicability due to the presence of moving parts.

It is therefore an object of this invention to provide an atomizer for a post-mixed burner, and a process for atomizing liquid fuel in a post-mixed burner, which is simple to use and avoids problems experienced by heretofore known atomizers and atomizing processes.

SUMMARY OF THE INVENTION

The above and other objects which will become apparent to one skilled in this art upon a reading of this disclosure are attained by the present invention, one aspect of which is:

An atomizer for a post-mixed burner comprising:

(A) a liquid fuel passage having a first length of relatively small cross-section, a second length of increasing cross-section having a radially outward taper, and a third length of relatively large cross-section, said third length communicating with a furnace zone; and (B) at least one atomizing fluid passage having an injection end angularly communicating with said fuel passage so as to direct atomizing fluid onto said second length proximate the start of the outward taper.

Another aspect of this invention comprises:

A process for atomizing liquid fuel in a post-mixed burner comprising:

(A) passing liquid fuel through a fuel passage having a first length of relatively small cross-section, a second length of increasing cross-section having a radially outward taper, and a third length of relatively large cross-section;

(B) angularly directing atomizing fluid into physical contact with said flowing liquid fuel proximate the start of the outward taper and across said second length to form a thin fuel layer on the fuel passage wall; and (C) passing fuel and atomizing fluid out from said third length into a furnace zone as an atomized spray.

BRIEF DESCRIPTION OF THE DRAWINGS

FIG. 1 is a cross-sectional representation of one preferred embodiment of the atomizer of this invention.

FIG. 2 is a cross-sectional representation of another preferred embodiment of the atomizer of this invention which is particularly preferred when the atomizing fluid is an oxidant.

DETAILED DESCRIPTION

The process and apparatus of this invention will be described in detail with reference to the drawings.

Referring now to FIG. 1, fuel passage 1 comprises three lengths. The first length 2 has a relatively small cross-section and communicates with second length 3 which has a radially outward taper and an increasing cross-section and which in turn communicates with third length 4 which has a relatively large cross-section and which communicates with furnace zone 5. The fuel passage 1 is connected to a source of liquid fuel which passes through the fuel passage at any effective rate to produce a firing rate generally within the range of from 0.5 to 3.0 million BTU/hr. Any effective liquid fuel may be employed in the process and with the apparatus of this invention. Among such liquid fuels one can name no. 2 fuel oil, no. 6 fuel oil, and coal-water mixtures. The liquid fuel will generally have a viscosity within the range of from 2.3 to 40.6 centipoise, and preferably within the range of from 15 to 18. More viscous fuels may be preheated to bring their viscosity within the range suitable for use with this invention. When No. 2 fuel oil, i.e., diesel fuel, is employed the flowrate will generally be within the range of from 0.06 to 0.36 gallons per minute. When No. 6 fuel oil is employed the flowrate will generally be within the range of from 0.057 to 0.34 gallons per minute.

After exiting the fuel passage, the fuel mixes with and combusts with oxidant in furnace zone 5. The oxidant is supplied to furnace zone 5 at a distance from the point where fuel is supplied to furnace zone 5. Preferably the oxidant is pure oxygen, or oxygen-enriched air comprising at least 25 percent oxygen, and is supplied to furnace zone 5 as a jet at least four oxidant jet diameters distant from the point where the fuel is supplied to the furnace zone.

Atomizing fluid is supplied to the fuel passage by means of at least one atomizing fluid passage 6. Atomizing fluid passage 6 communicates with fuel passage 1 at an angle proximate the start of the outward taper of second length 3, and its injection point is so disposed as to direct the atomizing fluid into physical contact with liquid fuel flowing through second length 3. The angle of atomizing fluid passage 6 to the axis of fuel passage 1 is within the range of from 45 to 75 degrees and preferably is about 60 degrees. This atomizing fluid is directed into fuel passage 1 at relatively high velocity, generally within the range of from 1000 to 15/0 feet per second. The high velocity atomizing fluid coming in contact with the liquid fuel causes the fuel to be pushed against the outwardly tapered wall of second section 3, and because of the increasing area of the outwardly tapered wall of second section 3, the liquid fuel is caused to form an increasingly thinner layer as it is pushed against and along the outwardly tapered wall of second section 3. The taper of second section 3 may be within the range of from 35 to 55 degrees and preferably is about 45 degrees with respect to the axis of the fuel passage.

As the thin liquid fuel layer is pushed along the fuel passage to the end of third section 4, the thin nature of the fuel film causes the film to be sheared off in very fine droplets as it enters furnace zone 5. Although the number of atomizing fluid passages employed is not critical, it is preferred that from three to seven equidistantly oriented atomizing fluid passages be employed. An odd number of atomizing fluid passages is particularly preferred. Generally each atomizing fluid passage 6 will be circular in cross-section and have a diameter within the range of from 0.03 to 0.05 inch. Preferably the diameter of the atomizing fluid passage will be within the range of from 0.5 to 1.0 times the diameter of the first length of the fuel passage.

Any effective atomizing fluid may be used in the practice of this invention. Among such atomizing fluids one can name nitrogen, steam, and oxidants such as air, oxygen-enriched air and pure oxygen. In a preferred embodiment of the process of this invention the atomizing fluid is an oxidant and at least some of this atomizing oxidant combusts with the liquid fuel within the fuel passage. This internal combustion causes the generation of a large volume of hot combustion gases which further enhances the pushing and thinning of the liquid fuel along the wall of the fuel passage and results in higher gas exit velocities resulting in enhanced shearing of the liquid film as it emerges from third section 4 and consequently in a greater degree of atomization of the liquid fuel as it enters furnace zone 5.

FIG. 1 also illustrates a preferred embodiment of the atomizer of this invention wherein the outer portion of the atomizer is threaded, thus facilitating insertion and removal of the atomizer into and from a burner head.

FIG. 2 illustrates another embodiment of the atomizer of this invention which is useful when the atomizing fluid is an oxidant and combustion of fuel and atomizing oxidant occurs within the fuel passage. The numerals of FIG. 2 are identical to those of FIG. 1 for the common elements. The FIG. 2 embodiment differs from that of FIG. 1 only in that the exit portion of third section 4 is decreased in cross-sectional area, such as by the insertion of ring element 7, proximate the point of communication with furnace zone 5. By use of the embodiment of FIG. 2, the converging nature of fuel passage 1 causes the gas exit velocity to suddenly increase and thus enhance the shearing of the fuel film as it is injected into furnace zone 5. This further contributes to the atomization of the liquid fuel.

Now by the use of the process and apparatus of this invention, one can easily and efficiently atomize liquid fuel in a post-mixed burner, while avoiding many heretofore experienced problems such as mechanical breakdown of moving parts, or plugging of very small liquid fuel orifices.

Although the process and apparatus of this invention have been described in detail with reference to certain specific embodiments, it is understood that there are other embodiments of this invention within the spirit and scope of the claims.

What is claimed is:

1. An atomizer for a post-mixed burner comprising:

(A) a liquid fuel passage having a first length of relatively small cross-section, a second length of increasing cross-section having a radially outward taper, and a third length of relatively large cross-section, said third length communicating with a furnace zone; and (B) at least one atomizing fluid passage having an injection end angularly communicating with said fuel passage so as to direct atomizing fluid onto said second length proximate the start of the outward taper.

2. The atomizer of claim 1 having from three to seven oxidant passages.

3. The atomizer of claim 1 wherein the taper is at an angle within the range of from 35 to 55 degrees with respect to the axis of the fuel passage.

4. The atomizer of claim 1 wherein the liquid fuel passage third length decreases in cross-section proximate the point of communication with the furnace zone.

5. The atomizer of claim 4 wherein the said cross-section decrease is achieved by a ring inserted in the third length proximate the point of communication with the furnace zone.

6. The atomizer of claim 1 wherein the atomizing fluid passage has a circular cross-section having a diameter within the range of from 0.5 to 1.0 times the diameter of the first length of the fuel passage.

7. The atomizer of claim 1 wherein the atomizing fluid passage angularly communicates with the fuel passage at an angle within the range of from 45 to 75 degrees with respect to the axis of the fuel passage.

8. A process for atomizing liquid fuel in a post-mixed burner comprising:

(A) passing liquid fuel through a fuel passage having a first length of relatively small cross-section, a second length of increasing cross-section having a radially outward taper, and a third length of relatively large cross-section;

(B) angularly directing atomizing fluid into physical contact with said flowing liquid fuel proximate the start of the outward taper and across said second length to form a thin fuel layer on the fuel passage wall; and (C) passing fuel and atomizing fluid out from said third length into a furnace zone as an atomized spray.

9. The process of claim 8 wherein said liquid fuel is from the group comprising no. 2 fuel oil and no. 6 fuel oil.

10. The process of claim 8 wherein said liquid fuel is a coal water mixture.

11. The process of claim 8 wherein said atomizing fluid is from the group comprising nitrogen and steam.

12. The process of claim 8 wherein said atomizing fluid is an oxidant from the group comprising air, oxygen-enriched air, and pure oxygen.

13. The process of claim 8 wherein the atomizing fluid is directed into contact with the liquid fuel at a velocity within the range of from 1000 to 1570 feet per second.

14. The process of claim 8 wherein the atomizing fluid is directed into contact with the liquid fuel at an angle within the range of from 45 to 75 degrees with respect to the axis of the fuel passage.

15. the process of claim 12 wherein said fuel entering the furnace zone from the fuel passage combusts in the furnace zone so as to cause at least some of the atomizing oxidant to combust with liquid fuel within the fuel passage.

16. The process of claim 8 wherein the liquid fuel has a viscosity within the range of from 2.3 to 40.6 centipoise.

17. The process of claim 8 wherein the liquid fuel flowrate is sufficient to establish a burner firing rate within the range of from 0.5 to 3.0 million BTU per hour.

* * * * *

UNITED STATES PATENT AND TRADEMARK OFFICE

CERTIFICATE OF CORRECTION

PATENT NO. : 4,738,614

DATED : April 19, 1988

INVENTOR(S) : W.J. Snyder et al

It is certified that error appears in the above-identified patent and that said Letters Patent is hereby corrected as shown below:

In column 2, line 58 delete "15/0" and insert therefor --1570--.

In claim 15, line 1 delete "the" and insert therefor --The--.

Signed and Sealed this

Sixth Day of September, 1988

*Attest:*

DONALD J. QUIGG

*Attesting Officer*

*Commissioner of Patents and Trademarks*